US008797226B2

(12) United States Patent
Ferris

(10) Patent No.: US 8,797,226 B2
(45) Date of Patent: Aug. 5, 2014

(54) ANTENNA HEAT FINS

(75) Inventor: Matthew Ferris, Plano, TX (US)

(73) Assignee: Andrew LLC, Hickory, NC (US)

( * ) Notice: Subject to any disclaimer, the term of this patent is extended or adjusted under 35 U.S.C. 154(b) by 541 days.

(21) Appl. No.: 13/132,514

(22) PCT Filed: Dec. 1, 2009

(86) PCT No.: PCT/US2009/066260

§ 371 (c)(1),
(2), (4) Date: Jul. 18, 2011

(87) PCT Pub. No.: WO2010/065543

PCT Pub. Date: Jun. 10, 2010

(65) Prior Publication Data

US 2011/0260944 A1 Oct. 27, 2011

Related U.S. Application Data

(60) Provisional application No. 61/119,224, filed on Dec. 2, 2008, provisional application No. 61/119,270, filed on Dec. 2, 2008.

(51) Int. Cl.
*H01Q 1/42* (2006.01)

(52) U.S. Cl.
USPC ..... 343/872; 343/702

(58) Field of Classification Search
USPC ..... 343/872, 702, 898, 834; 455/562.1, 561
See application file for complete search history.

(56) References Cited

U.S. PATENT DOCUMENTS

| | | | | |
|---|---|---|---|---|
| 6,640,110 | B1 * | 10/2003 | Shapira et al. | 455/562.1 |
| 7,106,273 | B1 | 9/2006 | Brunson | |
| 7,245,896 | B2 * | 7/2007 | Seo et al. | 455/300 |
| 2003/0052830 | A1 | 3/2003 | Ogawa et al. | |
| 2005/0277402 | A1 | 12/2005 | Yowakim et al. | |
| 2006/0202906 | A1 | 9/2006 | Okubo et al. | |
| 2011/0260944 | A1 * | 10/2011 | Ferris | 343/872 |
| 2013/0299125 | A1 * | 11/2013 | Shi et al. | 165/47 |

FOREIGN PATENT DOCUMENTS

| | | |
|---|---|---|
| JP | 2004-039857 | 2/2004 |
| JP | 2004039857 | 5/2004 |
| WO | WO 98/06146 | 2/1998 |
| WO | WO 02/39541 | 5/2002 |
| WO | WO 2004/064197 | 12/2003 |
| WO | WO 2004-064197 | 7/2004 |

OTHER PUBLICATIONS

European Search Report for related Patent Application No. EP 09 83 0986, Mar. 28, 2012.

WO 2010/065543 A3, related to PCT/US2009/066260, Jun. 10, 2010.

Written Opinion for related case PCT/US2009/066260. Mar. 28, 2012.

* cited by examiner

*Primary Examiner* — Thien M Le

(74) *Attorney, Agent, or Firm* — Husch Blackwell LLP

(57) ABSTRACT

A cellular communication antenna has a base with a length that exceeds its width and an inside surface with internal mounts for a plurality of electrical components that generate heat when in operation. A top encapsulates the electrical components and incorporates a radome. A plurality of fins are mounted on the outside surface of the base. They may be non-parallel with the length of the base. They may all be substantially the same length. They are further constructed and arranged to be in thermal communication with the electrical components such that heat generated by the electrical components is dissipated by the fins. Each fin may be in thermally conductive communication with more than one electrical component.

19 Claims, 6 Drawing Sheets

ANTENNA HEAT FINS

CROSS-REFERENCE TO RELATED APPLICATIONS

This application claims priority to U.S. Provisional Application No. 61/119,224, filed on Dec. 2, 2008 and to U.S. Provisional Application No. 61/119,270, also filed on Dec. 2, 2008 and to International Application No. PCT/US2009/066260, filed Dec. 1, 2009.

BACKGROUND OF THE INVENTION

1. Field of the Invention

The present invention is in the field of cellular radio frequency communication system antennas and in particular heat dissipation from them.

2. Related Art

Antennas for cellular radio frequency communication systems, for example cellular telephone antennas, are advantageously arranged in configurations having a length that substantially exceeds the width of the antenna. A typical antenna may be two meters long and 30 centimeters wide. These antennas are usually mounted so that their long axis is substantially vertical. They are most frequently mounted on a cell phone tower that is often as high as 200 feet.

The antennas contain electrical components including modular radios, power supplies and/or transformers, radio frequency emitters and other components. In operation, these components generate heat. This heat should be dissipated in order to keep the operating electrical components at an advantageous temperature for effective and durable operation.

The antennas usually have a radome on one side. The antennas are typically mounted with the radome outermost, and with a back surface of the antenna facing the tower, as well as other structure, antennas and equipment that may also be mounted on the tower.

Active cooling components such as fans are problematic to install high on antenna towers, and so it is desirable to dissipate heat from antennas by passive means. Preexisting designs mounted heat dissipating fins on the back of the antenna. However, these fins were vertically aligned along the length of the antenna. Air heated by the components in the lower portion of the antenna would rise along the fins. The upper portions of the fins receiving this pre-heated air could not transfer heat from the upper components of the antenna efficiently. Further complicating considerations include the presence of the antenna in the open air during normal operations and the orientation of the heat exchanging (back) surface of the antenna towards the tower structure and other equipment mounted there. Of course, economy and the fabrication of components remains a consideration.

SUMMARY OF THE INVENTION

A cellular communication antenna has a base with a length that exceeds its width and an inside surface with internal mounts for a plurality of electrical components that generate heat when in operation. A top encapsulates the electrical components and incorporates a radome. A plurality of fins are mounted on the outside surface of the base. They may be non-parallel with the length of the base. They may all be substantially the same length. They are further constructed and arranged to be in thermal communication with the electrical components such that heat generated by the electrical components is dissipated by the fins. Each fin may be in thermally conductive communication with more than one electrical component. Fins may be arranged in groups, and separated by gaps. The gaps may include baffles.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
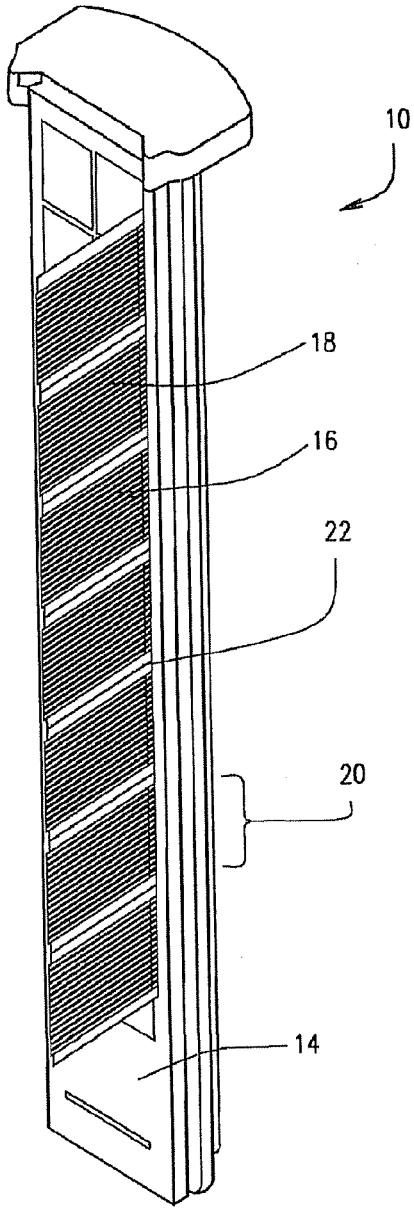
FIG. 1 is a rear perspective view of the antenna of the present invention.
Figure 2:
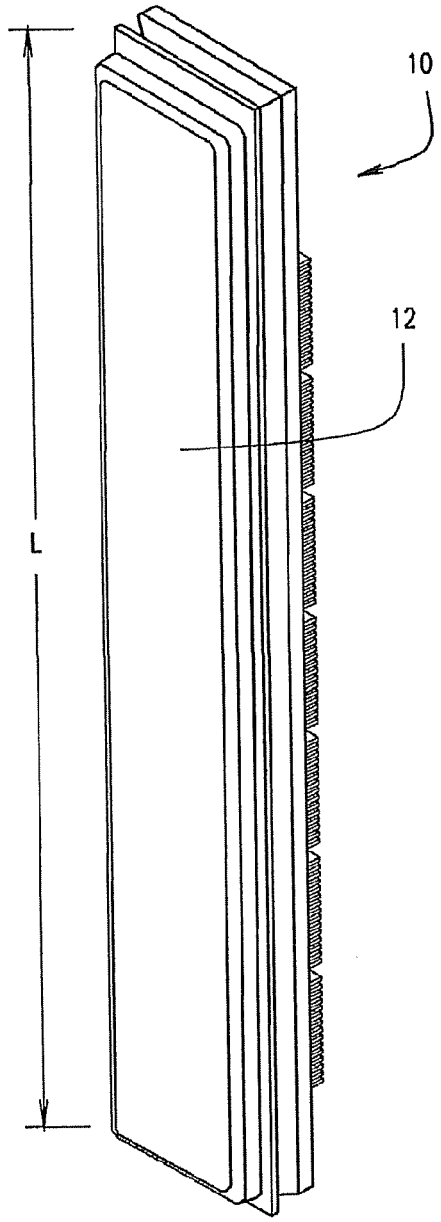
FIG. 2 is a front perspective view.

Referring now to the drawings wherein like reference numbers indicate like elements, Cellular telephone antenna 10 includes a curved, front radome 12 and a rear housing back 14. The radome and back maintain a space therebetween in which electrical antenna components are mounted. FIG. 1 is a rear perspective view of the antenna 10 of the present invention showing fins 16 mounted on a base that is the outer surface of a housing back 14. FIG. 2 depicts the front of the antenna showing a top that includes a radome 12.

The cellular communications antenna 10 is dimensioned to have a length L. Electrical components are arranged generally in line along the length L of cellular communications antenna 10.

As depicted in FIG. 1, each of the plurality of fins has substantially the same length. Each pair of fins defines a space 18 therebetween. Each space has an opening on a lower portion of said space, which is to the left in FIG. 1, and an opening on an upper portion which is to the right in FIG. 1. These openings are to the side of the antenna. The lower opening provides an entrance for fresh, unheated air into the space 18 between two fins 16 and the upper opening of the space allows an exit for heated air.

In the depicted embodiment the fins 16 are divided into groups 20 which in FIG. 1 are parallelograms. Configuring the fin array groups 20 in this shape allows each fin to be the same length, which advantageously allows each space 18 to open to one side and eject heated air to the other side. The fin array groups 20 are separated by spaces 22. The spaces 22 may be used for mounting the overall panel supporting fins 16 to the base 14.

In still air, the configuration of the present invention allows convection to create advantageous air flow through the spaces 18 and between fins 16. The configuration of the present invention is further advantageous in windy conditions, in that the opening of the spaces to the side of the antenna readily allows ingress of air into all spaces 18 between all fins 16.

Each fin is substantially the same length in the depicted embodiment. Each fin is non-parallel to the length of the overall antenna. In the depicted embodiment, the fins are at an angle between about 40 degrees and about 75 degrees from horizontal, thereby allowing convection to cause air to move through the spaces 18 between the fins 16 as the heated air rises. Vertical or near vertical angles are avoided. Fin arrays with spaces that do not open to the side of the antenna are avoided. Thus, the invention avoids air heated in the lower portion of the antenna to disadvantageously enter the space between fins dissipating heat from the top portions of the antenna.

Figure 3:
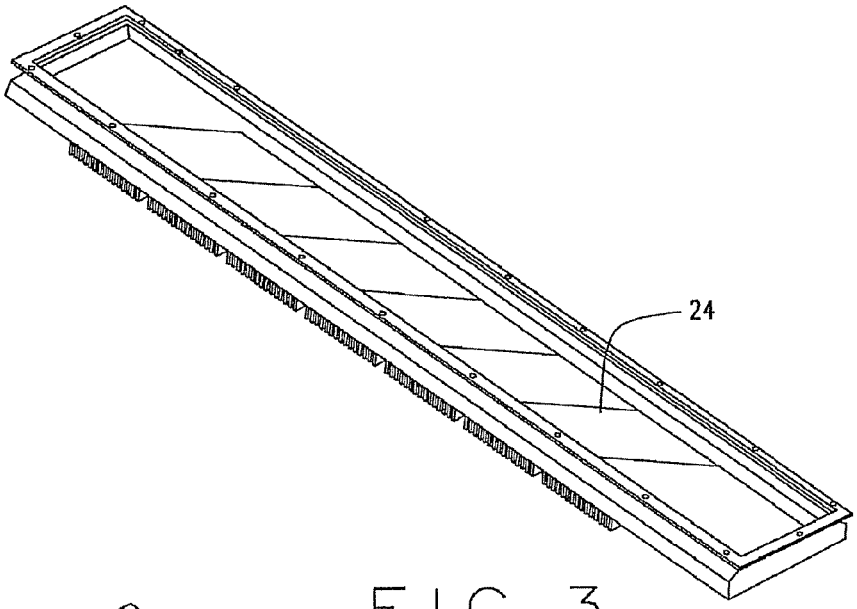
FIG. 3 is a top perspective view of the base of the antenna of the present invention.
Figure 4:
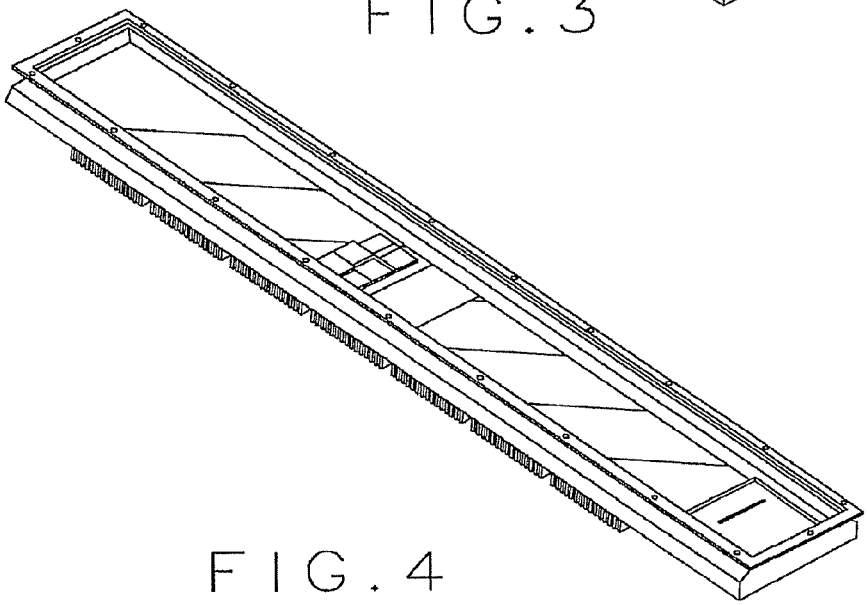
FIG. 4 is a top perspective view of the base of the antenna of the present invention.
Figure 5:
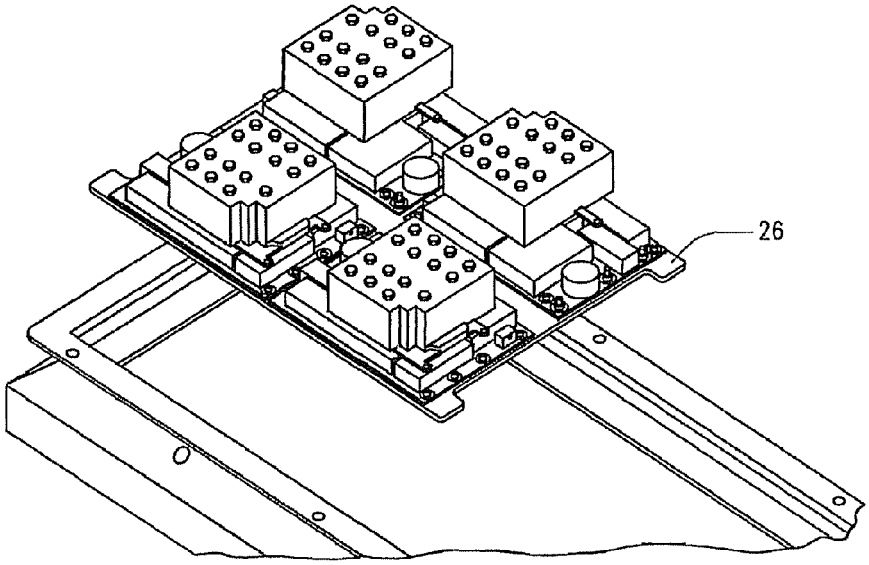
FIG. 5 is a top perspective view of the base of the antenna of the present invention.
Figure 6:
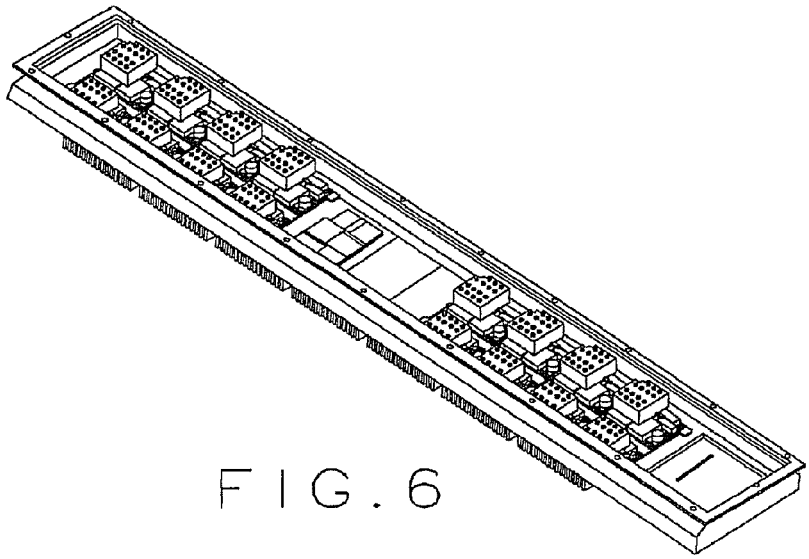
FIG. 6 is a top perspective view of the base of the antenna of the present invention.

An interior view of the base 14 is shown without electrical components in FIG. 3 and shown with only selected electrical components in FIG. 4. The mounted perimeter of each group of fins 20 is shown by diagonal lines 24, in relation to the electrical components whose heat they will serve to dissipate. As can be seen in FIGS. 4 and 5 each group of fins 20 may be mounted such that the angle and position of the fins may conduct heat away from more than one electrical component mounted within the base. The antenna may be configured so that each individual fin 16 is in thermal communication with more than one electrical component. The electrical components in the antenna will include modular radios, a calibration radio, a calibration hub, a power supply or transformer and the like. There may be a plurality of some of the components, such as the modular radios, within the same antenna. As seen in FIG. 6, in the depicted embodiment, modules 26 may be fabricated onto which the electrical components may be mounted. The modules may thereafter be assembled and attached to the base. Accordingly, the configuration depicted herein wherein each diagonal array of fins may conduct heat away from more than one electrical component may alternatively be constructed and arranged such that each array of fins 20 may conduct heat away from more than one module 26 mounting electrical components. The same may be true of an individual fin in alternate embodiments.

Figure 7:
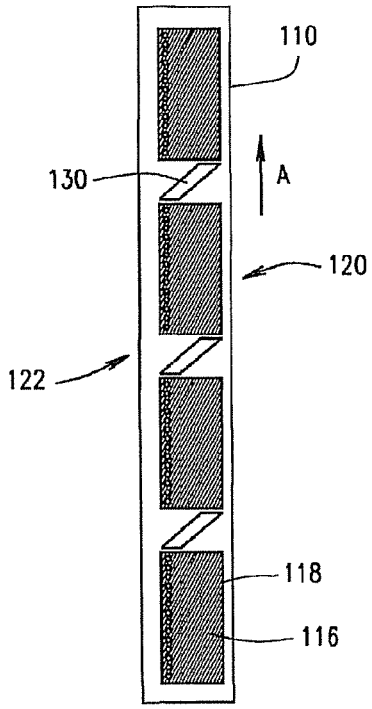
FIG. 7 is a perspective view of the fins of an alternate embodiment.

In the embodiment depicted in FIG. 7, each array 120 of fins 116 has a plurality of fins separated by a plurality of spaces 118. The fins are not parallel to the length longitudinal dimension of the cellular communications antenna 110. In the usual vertical deployment of the antenna 110, the fins 116, will be non-vertical. Because hot air rises, air in spaces 118 that is warmed by convection from fins 116 will move in the direction indicated in the figures by arrow A. Cool, fresh air will thereafter enter the spaces 118 from the lower end of spaces, which is to the left in FIG. 7. Because the fins 116 are angled, heated air leaving spaces 118 will exit the array and travel away from the antenna 110. The majority of heated air exiting the spaces will not reenter the next array of the rail, because the angle of the fins 116 will direct the heated air away.

In the embodiment depicted in FIG. 7, the arrays may be separated by a gap or open space 122. A baffle 130 may be deployed in this gap 122. This gap 122 and/or baffle 130 allow air heated by a fin array 120 below it to dissipate (to the right in FIG. 7). In this way, fresh unheated air will enter the gap 122 (from the left in FIG. 7) and enter the spaces 118 of the fin array 120 above the gap 122.

In a breeze, the opening of spaces 118 and baffles 130 to the side of the fin array allows for moving air to be more readily received into the spaces 118 between fins 116, thereby further promoting cooling.

Figure 8:
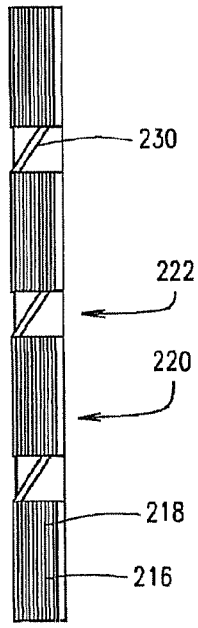
FIG. 8 is a perspective view of the fins of an alternate embodiment.

In another embodiment depicted in FIG. 8, fins 216 in fin arrays 220 remain vertical. Further, the fin arrays 220 remain spaced apart by a gap 222. However, within the gaps is a diagonal baffle 230. Thus, heated air travels substantially vertically in spaces 218 until the heated air exits the fin array, whereupon it is directed not vertically but to the side by baffle 230. Thus, cool air (from the left in FIG. 8) is received into the bottom of spaces 218 of the fin array 220 above the baffle.

Figure 9:
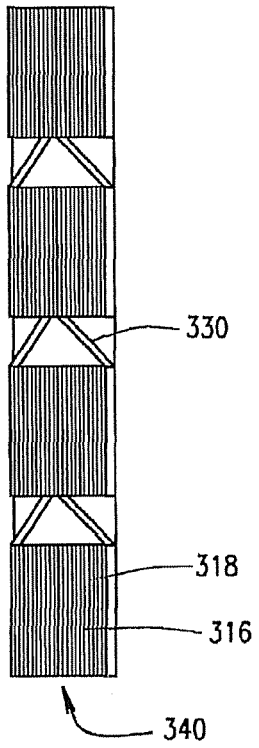
FIG. 9 is a perspective view of the fins of an alternate embodiment.

In a another alternative embodiment depicted in FIG. 9, fins 316 and spaces 318 between them are arranged in parallel but in spaced relation to define a central vertical channel 340 therebetween. Baffles 330 are deployed back to back or in a mirror image configuration, forming inverted chevrons. The direction of convection into channel 340 promotes an air current to draw cooler air into the spaces 318.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A cellular communication antenna comprising:

a base having a length and a width and having an inside surface and an outside surface;

said base having mounts for a plurality of electrical components, said electrical components generating heat when in operation;

a top encapsulating said electrical components, said top incorporating a radome;

a plurality of fins mounted on said outside surface of said base, said fins being non-parallel with said length of said base and at an angle between about 40 degrees and about 75 degrees from horizontal; and said fins being in thermal communication with said electrical components such that heat generated by said electrical components is dissipated by said fins.

2. The antenna of claim 1 wherein each of said fins is substantially the same length.

3. The antenna of claim 1 wherein said fins define spaces therebetween, each of said spaces opening on a side of said antenna such that unheated air may enter said spaces from the side.

4. The antenna of claim 1 wherein said fins define spaces, each of said spaces opening on a side of said antenna such that heated air may exit said spaces to the side.

5. The antenna of claim 1 wherein said base is a generally planar rectangle.

6. The antenna of claim 1 wherein said electrical components are mounted on modules;

each of said fins being deployed to be in thermal communication with at least two of said modules.

7. The antenna of claim 6 wherein said fins are deployed in groups, each group being in thermal communication with at least two of said electrical components.

8. The antenna of claim 1 wherein said fins are deployed in groups, each group being in thermal communication with at least two of said electrical components.

9. The antenna of claim 8 wherein said fins define spaces therebetween, each of said spaces opening on a side of said antenna such that unheated air may enter said spaces from the side.

10. The antenna of claim 8 wherein said fins define spaces, each of said spaces opening on a side of said antenna such that heated air may exit said spaces to the side.

11. The antenna of claim 8 wherein each of said fins is substantially the same length.

12. The antenna of claim 1 further comprising:

said fins being arranged in groups; and said groups being separated by gaps.

13. The antenna of claim 12 wherein said fins define spaces therebetween, each of said spaces opening on a side of said antenna such that unheated air may enter said spaces from the side.

14. The antenna of claim 12 wherein said fins define spaces, each of said spaces opening on a side of said antenna such that heated air may exit said spaces to the side.

15. The antenna of claim 12 wherein said electrical components are mounted on modules;

each of said groups of fins being deployed to be in thermal communication with at least two of said modules.

16. The antenna of claim 12 further comprising said groups being in thermal communication with at least two of said electrical components.

17. The antenna of claim 12 further comprising a baffle disposed in said gap.

18. The antenna of claim 17 further comprising a pair of said baffles forming a chevron.

19. The antenna of claim 1 further comprising a central vertical channel.

* * * * *